US005675366A

United States Patent [19]

Hayasaki et al.

[11] Patent Number: 5,675,366

[45] Date of Patent: Oct. 7, 1997

[54] RECORDING APPARATUS AND RECORDING HEAD SUBSTRATE FOR USE IN THE SAME

[75] Inventors: Kimiyuki Hayasaki; Akira Katayama, both of Yokohama; Hideaki Kishida, Yamato, all of Japan

[73] Assignee: Canon Kabushiki Kaisha, Tokyo, Japan

[21] Appl. No.: 483,879

[22] Filed: Jun. 7, 1995

Related U.S. Application Data

[63] Continuation of Ser. No. 35,901, Mar. 23, 1993, abandoned, which is a continuation of Ser. No. 490,453, Mar. 8, 1990, abandoned.

[30] Foreign Application Priority Data

Mar. 10, 1989 [JP] Japan ..... 1-58928

[51] Int. Cl.[6] ..... B41J 2/05

[52] U.S. Cl. ..... 347/58; 347/59; 347/208; 347/209

[58] Field of Search ..... 347/57–59, 208–21

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,636,813 | 1/1987 | Mego et al. | 346/76 PH |
| 4,651,164 | 3/1987 | Abe et al. | 346/76 PH |
| 4,695,855 | 9/1987 | Ichihashi et al. | 346/145 |
| 4,712,119 | 12/1987 | Kiyohara | 346/140 R |
| 4,723,129 | 2/1988 | Endo et al. | 346/1.1 |
| 4,740,796 | 4/1988 | Endo et al. | 346/1.1 |
| 4,764,659 | 8/1988 | Minami et al. | 346/76 PH |
| 4,922,269 | 5/1990 | Ikeda et al. | 346/140 R |

FOREIGN PATENT DOCUMENTS

| | | | |
|---|---|---|---|
| 0128760 | 12/1984 | European Pat. Off. . | |
| 54-56847 | 5/1979 | Japan . | |
| 59-123670 | 7/1984 | Japan . | |
| 59-138461 | 8/1984 | Japan . | |
| 60-71260 | 4/1985 | Japan . | |
| 60-172544 | 9/1985 | Japan . | |
| 0172555 | 9/1985 | Japan | 346/76 PH |
| 60-187566 | 9/1985 | Japan . | |
| 61-239961 | 10/1986 | Japan . | |
| 62-211157 | 9/1987 | Japan . | |
| 62-259878 | 11/1987 | Japan . | |
| 1-67361 | 3/1989 | Japan | 347/209 |

*Primary Examiner*—Benjamin R. Fuller
*Assistant Examiner*—Juanita Stephens
*Attorney, Agent, or Firm*—Fitzpatrick, Cella, Harper & Scinto

[57] ABSTRACT

A recording head has a substrate on which a plurality of heat generating elements as recording elements are arranged and a plurality of driving integrated circuits (driving ICs) to drive the plurality of heat generating elements are supported. The recording head comprises wirings which are extended from the heat generating elements and pass through a region on the substrate on which the driving ICs are supported and are connected to the driving ICs; signal series wirings which are arranged on the heat generating element side of the substrate, are closer to the heat generating elements than terminals for the wiring connection, and serially connect the driving ICs; and conductors which are formed in a region on the substrate between the adjacent driving ICs and connect recording current to the ground.

13 Claims, 5 Drawing Sheets

RECORDING APPARATUS AND RECORDING HEAD SUBSTRATE FOR USE IN THE SAME

This application is a continuation of application Ser. No. 08/035,901 filed Mar. 23, 1993, which was a continuation of application Ser. No. 07/490,453 filed Mar. 8, 1990, both now abandoned.

BACKGROUND OF THE INVENTION

1. Field of the Invention

The present invention relates to a recording apparatus and a recording head substrate for use in the recording apparatus and, more particularly, to a recording head using thermal energy as an energy to form pixels, that is, a recording head such as an ink jet recording head using heat generating elements as discharge energy generating elements to discharge inks, a thermal head having heat generating elements to copy transfer inks or to color a thermal paper, or the like and the invention is suitable for use in a substrate for such a head.

2. Related Background Art

In such a kind of recording head, generally, a number of heat generating elements are formed on a head substrate to thereby realize a high density recording and driving circuits to drive the heat generating elements are integratedly arranged on the head substrate in a form of an integrated circuit (IC), thereby miniaturizing the recording head.

As a number of heat generating elements which are formed increases, a plurality of ICs of the driving circuits (hereinafter, referred to as driving ICs) are also provided. However, in the conventional recording head wiring system in which a plurality of driving ICs are installed, there has been known a construction such that in order to avoid the formation of a multilayer, the signal series wirings are arranged on the opposite side for the recording surface of the head rather than the wiring terminals which are extended from the heat generating elements and are connected to the driving ICs and conductors for grounding recording currents are arranged under the driving ICs, thereby realizing a substantial single layer.

On the other hand, as disclosed in JP-A-60-187566, there has been known a method or the like whereby in the case of a recording head in which a number of heat generating elements are divided into a few blocks and the driving is executed for every block, the earth conductors of recording currents are divided into two sections and the signal series wirings are connected between the two sections. On the other hand, as disclosed in JP-A-62-211157, there has also been known an example in which the earth conductors of recording currents are provided between the adjacent driving ICs and the signal series wirings are arranged so as to form a multilayer together with the earth conductors.

However, in the example in which the earth conductors of the recording currents are arranged under the driving ICs, either the wirings which are extended from the heat generating resistor elements and are connected or the recording current earth conductors are limited depending on the sizes of driving ICs. That is, in the case of installing relatively large driving ICs onto the same substrate as in the ink jet recording head which consumes a large current, it is substantially difficult to arrange the wirings which are connected to the heat generation resistor elements because of its space. On the contrary, in the case where the driving ICs are highly densely installed onto the same substrate so that the longitudinal direction of each driving IC is set to be long in the vertical direction, the area of the recording current earth conductor which is arranged in the central portion of the driving IC is small, so that an earth resistance increases.

On the other hand, in the conventional example in which the signal series wirings of the driving ICs are formed in a multilayer together with the recording current earth conductors, there are problems such that the costs of the recording head are high and the reliability deteriorates due to factors of problems or the like such as deterioration of the yield by the complication of the manufacturing steps and mixture of noises to the signal series wirings.

SUMMARY OF THE INVENTION

It is an object of the present invention to solve the above problems.

To accomplish the above object, according to the first embodiment of the invention, there is provided a recording head having a substrate on which a plurality of heat generating elements as recording elements are arranged and a plurality of driving integrated circuits (driving ICs) to drive the plurality of heat generating elements are installed, wherein the recording head comprises: wirings which are extended from the heat generating elements and pass through the region on the substrate on which the driving ICs are installed and are connected to the driving ICs; signal series wirings which are arranged on the heat generating element side on the substrate rather than terminals to execute the wiring connection and serially connect the driving ICs; and conductors which are formed in the region on the substrate between the adjacent driving ICs and connect recording currents to the ground.

According to the second embodiment of the invention, there is provided a substrate for a recording head on which a plurality of heat generating elements to generate thermal energies which are used to record are arranged and a plurality of driving integrated circuits (driving ICs) to drive a plurality of heat generating elements are installed, wherein the substrate comprises: wirings which are extended from the heat generating elements and pass through the region on the substrate on which the driving ICs are installed and are formed and connect to the driving ICs; signal series wirings which are arranged on the heat generating element side on the substrate rather than terminals to execute the wiring connection and serially connect the driving ICs; and conductors which are formed in the region on the substrate between the adjacent driving ICs and connect recording currents to the ground.

According to the present invention, the wirings which are extended from the heat generating elements and are connected are arranged in the central portion of the region in which the driving ICs are installed and are connected to the driving ICs of the heat generating element wirings, a plurality of signal series wirings are arranged on the heat generating element side (recording surface side) on the head rather than the terminals for such a wiring connection, and the conductors to connect the recording currents to the ground are arranged in the gap between the adjacent driving ICs. Thus, a plurality of driving ICs can be highly densely installed onto the same substrate and the area of the conductor to connect the recording current to the ground can be increased. Therefore, the conductor layer can be substantially formed in a single layer and a recording head of low cost and high reliability can be realized

DETAILED DESCRIPTION OF THE PREFERRED EMBODIMENT

The present invention will be described in detail hereinbelow with reference to the drawings.

Figure 1:
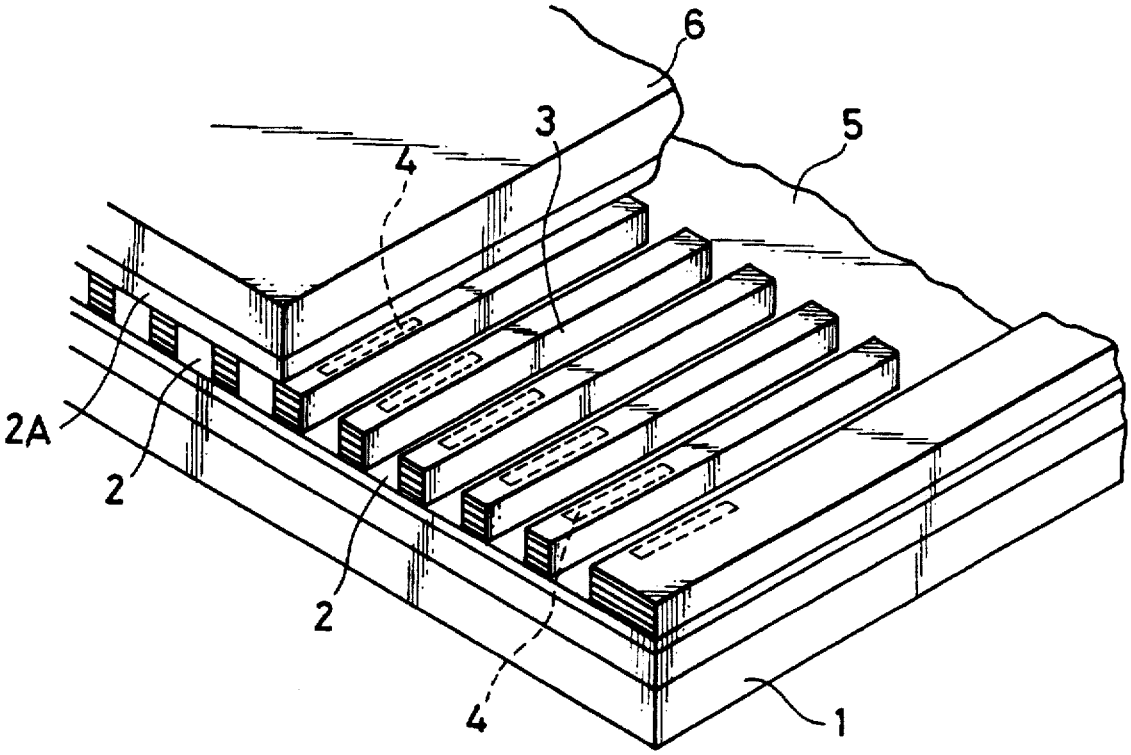
FIG. 1 PRIOR ART
FIG. 1 is a perspective view showing an example of a construction of an ink jet recording head to which the present invention can be applied.

FIG. 1 shows an example of a recording head to which the present invention can be applied. Particularly, FIG. 1 shows the ink jet recording head called a full-multi type in a form in which discharge ports are aligned in a range corresponding to the whole width of a recording medium.

Reference numeral 4 indicates a heat generating resistor element as a heat generating element which generates heat in accordance with the current supply and produces a bubble in ink to thereby discharge the ink. The heat generating resistor elements are formed together with wirings onto a substrate 1 by a manufacturing process similar to that of a semiconductor. Reference numeral 2A indicates a liquid channel forming member to form discharge ports 2 and liquid channels 3 communicated therewith in correspondence to the heat generating elements 4; 6 denotes a top plate; and 5 represents a liquid chamber which is commonly communicated with the liquid channels 3. Ink supplied from an ink supply source (not shown) is stored in the liquid chamber 5.

Figure 2:
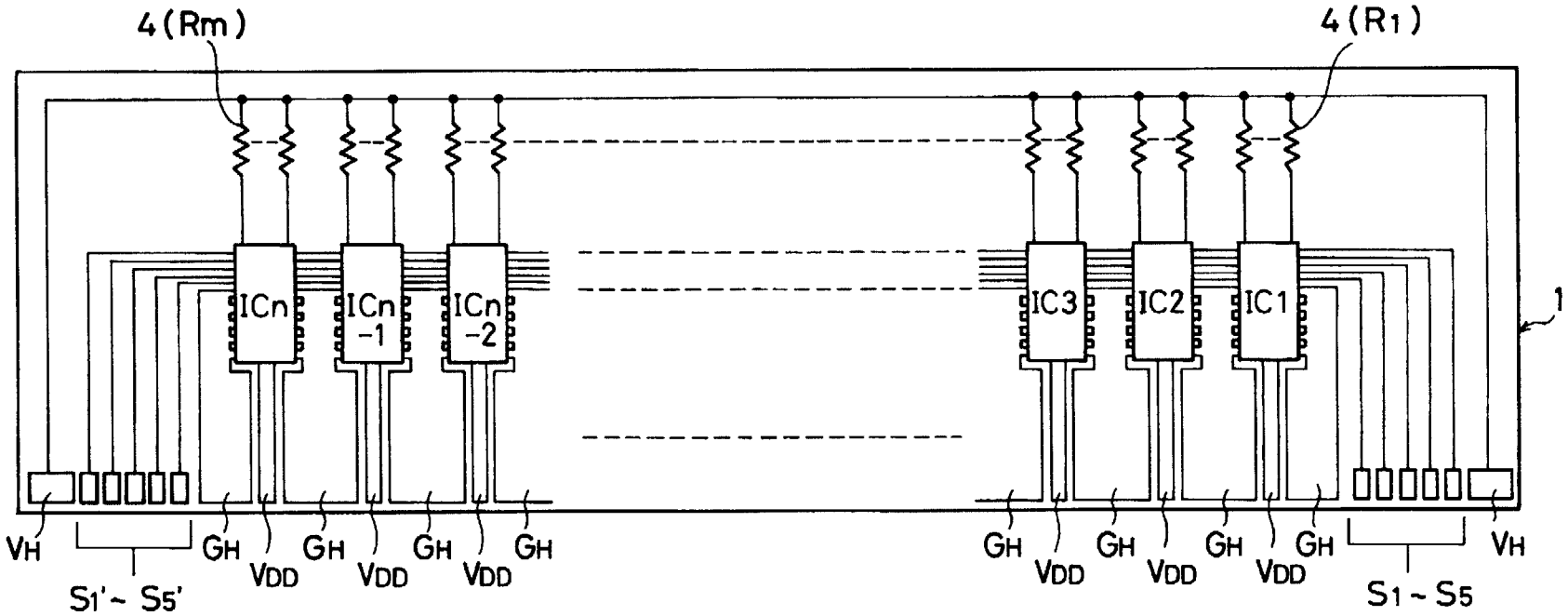
FIGS. 2 and 3 are a diagrammatical view showing an example of wirings on a substrate of the recording head shown in FIG. 1 and an enlarged diagram of the main section of the same.

FIG. 2 diagrammatically shows the wirings on the substrate 1 in FIG. 1.

$V_H$ denotes a common electrode to apply a recording voltage to a plurality of heat generating resistor elements 4 ($R_1$ to $R_m$). $S_1$ to $S_5$ and $S_1'$ to $S_5'$ denote signal series wirings. Input/output terminals are arranged in an edge portion of the head substrate 1 and are aligned on the head recording surface side of a plurality of driving ICs ($IC_1$ to $IC_n$). Various kinds of signals such as recording data (DATA), signal transmitting clock (SLCK), latch signal (LAT), strobe signal (STRB) to divisionally drive the ICs, transfer clock (ECLK) of a signal to divisionally drive the ICs, and the like are transmitted by the signal series wirings. $G_H$ denotes grounding semiconductors for recording currents which are arranged on both sides of each of the driving ICs. Terminals to apply a voltage $V_{DD}$ to drive the driving ICs ($IC_1$ to $IC_n$) are arranged between the $G_H$ terminals.

Figure 3:
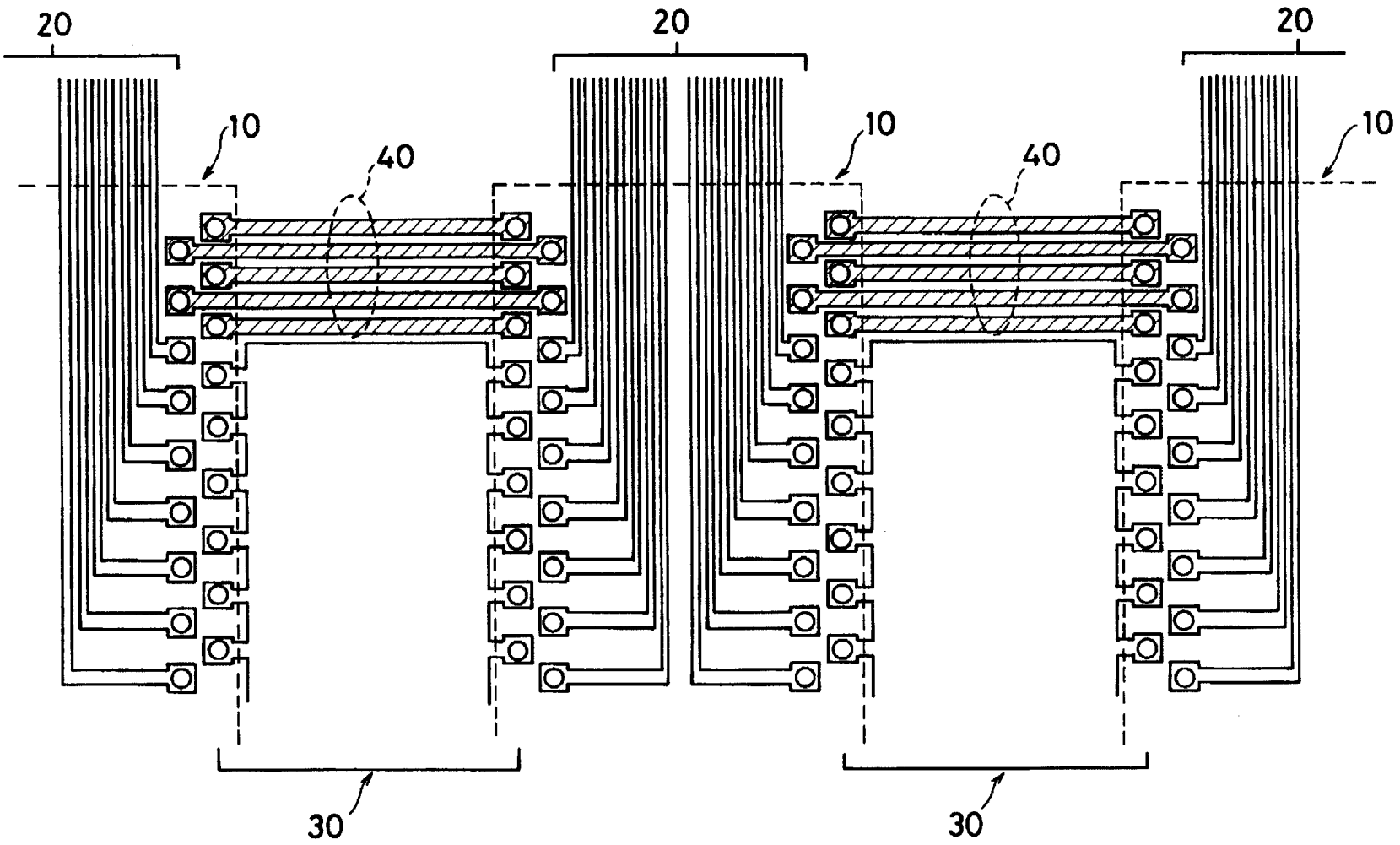

FIG. 3 is an enlarged diagram of the portion to install the driving ICs in FIG. 2. A broken line shown by reference numeral 10 indicates a space to install a driving IC having a shift register, a latch circuit, and an element which functions as a driver or the like. Wirings 20 to connect to a plurality of heat generating resistor elements are arranged in the space 10. On the other hand, as shown by 30, a plurality of earth terminal wirings of the driving ICs are arranged so as to commonly use the earth terminals provided on both sides of the adjacent driving ICs. The wirings connected to the heat generating resistor elements are short-circuited to the earth terminal wirings in the driving ICs in accordance with an image signal. At this time, currents are supplied from the common electrode $V_H$ to the heat generating resistor elements 4, wirings 20, and earth terminal wirings 30, so that the heat generating resistor elements 4 generate the heat and the ink is discharged.

Reference numeral 40 indicates wirings corresponding to the signal series wirings $S_1$ to $S_5$ and $S_1'$ to $S_5'$.

Figure 4:
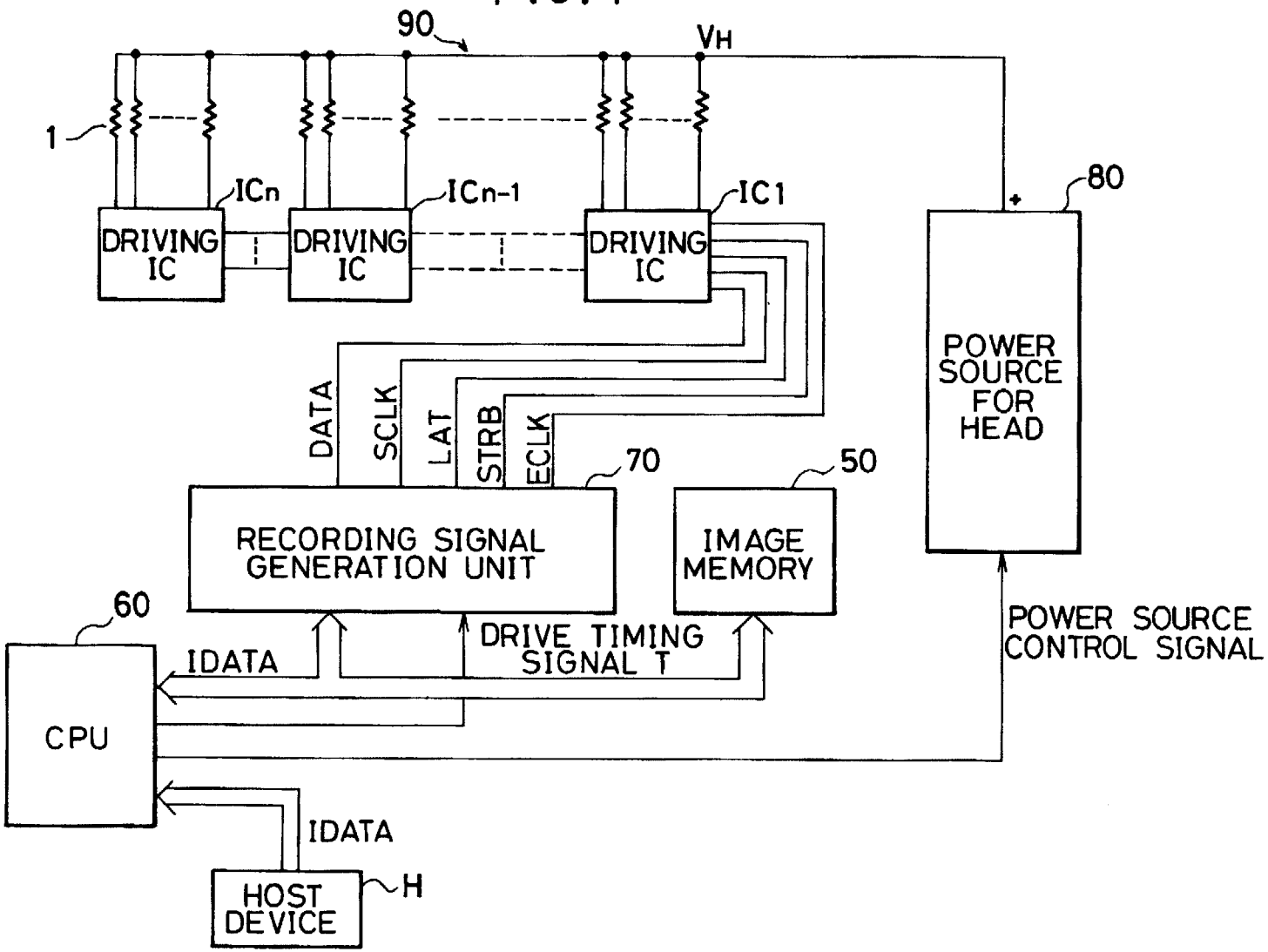
FIGS. 4 and 5 are a block diagram showing an example of a control system of an ink jet recording apparatus which is constructed by using the recording head according to the embodiment and a perspective view showing an example of a mechanical construction of the recording apparatus.

FIG. 4 shows an example of a construction of a control system for the recording head with the construction mentioned above. Reference numeral 90 denotes a recording head.

The head driving ICs ($IC_1$ to $IC_n$) provided for every predetermined number of heat generating elements 4 ($R_1$ to $R_m$) have: shift registers for aligning the data signals DATA of one line by making one bit correspond to each heat generating element 4; latch circuits to latch the bit data in response to latch signals LAT; switches to turn on/off the current supply to the heat generating elements 4 on the basis of the bit data in response to the strobe signals STRB as mentioned above; and the like. Reference numeral 50 denotes an image memory to store image data IDATA which is supplied directly from a host device H as an image data supply source or through a main control unit 60 of the recording apparatus. Reference numeral 70 indicates a recording signal generation unit. In response to a drive timing signal T from the main control unit 60, the generation unit 70 reads out the image data stored in the image memory 50, generates the data signal DATA, clock signals SCLK and ECLK, and latch signal LAT, and also generates the strobe signal STRB to divisionally drive the head driving ICs ($IC_1$ to $IC_n$), and the like. Reference numeral 80 represents a power source for the head to apply a voltage to the common electrode $V_H$ upon recording.

Figure 5:
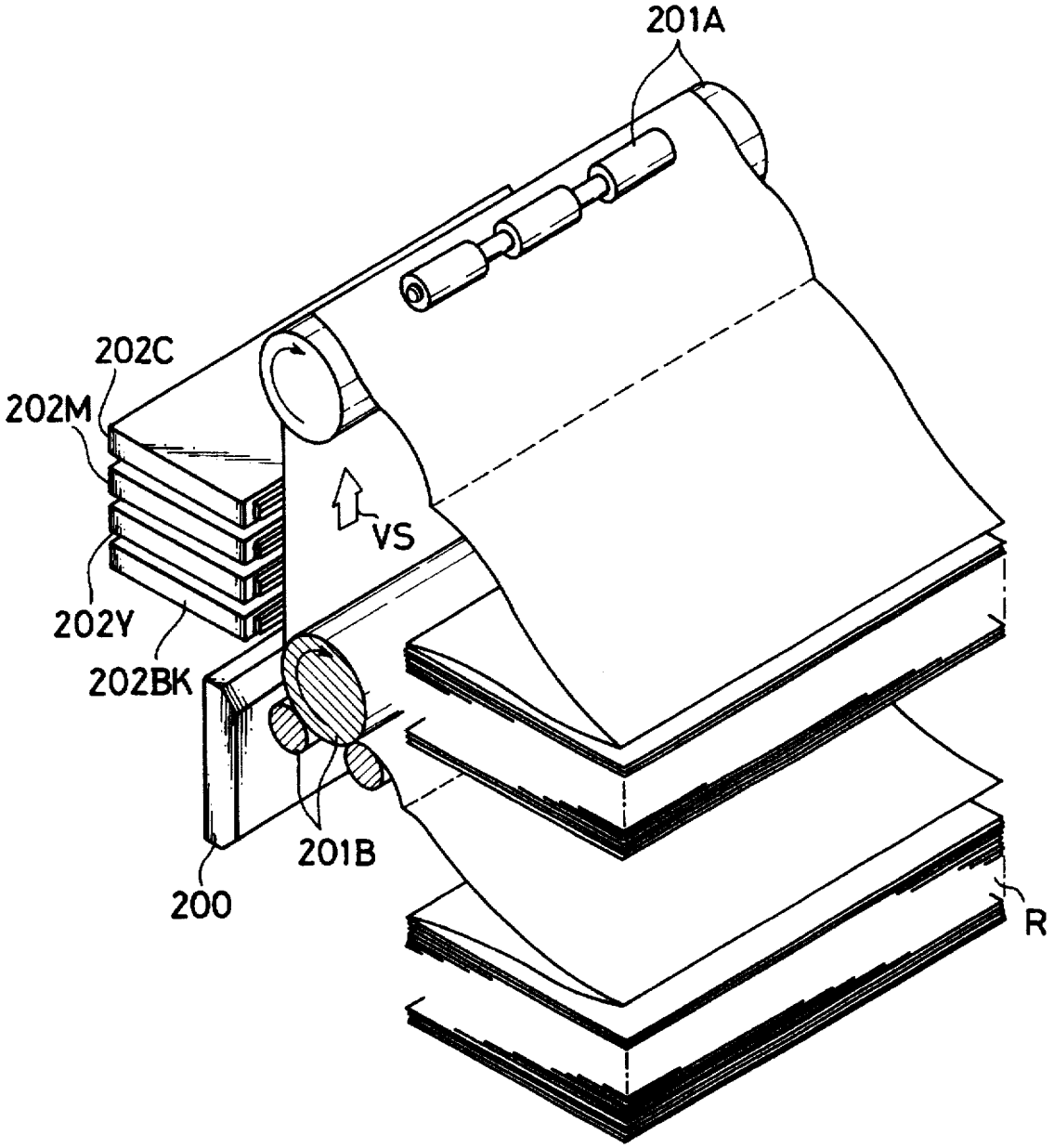

A line printer which can execute, for instance, the full-color recording as shown in FIG. 5 can be constructed by using the above recording head and its control system.

In FIG. 5, reference numeral 201A and 201B denote a pair of rollers provided to sandwich and covey a recording medium R in a sub scanning direction $V_s$. Reference numerals 202BK, 202Y, 202M, and 202C denote recording heads of the full-multi type (full-line type) in which orifices are arranged with respect to the whole width of the recording medium R. These recording heads record the inks in black, yellow, magenta, and cyan, respectively. The recording heads are arranged in accordance with the order of black, yellow, magenta, and cyan from the upstream side in the conveying direction of the recording medium. Reference numeral 200 indicates a recovery system which faces the recording heads 202BK to 202C in place of the recording medium R upon discharge recovering process.

In the embodiment, as shown in FIGS. 2 and 3, all of the signal series wirings are arranged on the recording surface side of the head rather than the terminal portion of the wirings which are extended from a plurality of heat generating resistor elements and are connected to the driving ICs. Thus, the formation of a multilayer with the signal series wirings or other conductors is avoided. Moreover, the area of the earth conductor of the recording current can be widened, so that the earth resistance can be reduced. Therefore, the conductors can be substantially formed in a single layer and a recording head of low costs and a high reliability can be realized.

Although five signal series wirings have been used in the embodiment, any proper number of signal series wirings may be used as desired. For example, a data wiring for tone recording or a signal wiring for individual driving or the like may be also added. On the other hand, a circuit type of the driving IC can be also obviously set to an arbitrary desired type such as bipolar type, MOS type, BiCMOS type, or the like. As a form of the head, a type such as to chop a large current like an ink jet recording head of the full-multi type as in the above example can be also sufficiently used. Even an ink jet recording head in a form in which the elements are serially scanned or a thermal head can be also widely applied to a recording head having a plurality of heat generating resistor elements.

Since the ink jet head requires relatively greater current rather than the thermal head drive current, an area on which drive IC is mounted would become larger. It is necessary to reduce a drop voltage of recording current grounding conductor at a head substrate side. Further, due to a greater current flowing through a wiring within the head, there would be not a few possibility of noise generation.

In contrast to such ink jet head, it is particular effective to use the present invention wherein a grounding conductor is provided at an area as much as possible except for a signal line wiring and IC mount position on a substrate, and the signal line wiring is provided at a vicinity of the head orifice rather than the grounding conductor. In particular, a full line type head comprising a plurality of orifices, for example, more than 2000 or 4000 are provided for a width of the recording area of the recording medium, may be used desirably.

Further, the spirit of the invention is not lost even in the case where a film thickness of a part of or all of the earth conductors is changed in accordance with a magnitude of the recording current or a plating is made on the earth conductors. In addition, as a method of installing the driving ICs, various kinds of methods such as wire bonding, flip chip, and the like can be also obviously used.

The present invention brings about excellent effects particularly in a recording head, or recording device of the bubble jet system among the ink jet recording systems.

As to its representative constitution and principle, for example, one practiced by use of the basic principle disclosed in, for example, U.S. Pat. Nos. 4,723,129 and 4,740,796 is preferred. This system is applicable to either of the so called on-demand type and the continuous type. Particularly, the case of the on-demand type is effective because, by applying at least one driving signal which gives rapid temperature elevation exceeding nucleus boiling corresponding to the recording information on electricity-heat converters arranged corresponding to the sheets or liquid channels holding liquid (ink), heat energy is generated at the electricity-heat converters to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into pulse shapes, growth and shrinkage of the bubble can be effected instantly and adequately to accomplish more preferably discharging of the liquid (ink) particularly excellent in response characteristic. As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination constitutions of discharging orifice, liquid channel, electricity-heat converter (linear liquid channel or right angle liquid channel) as disclosed in the above-mentioned respective specifications, the constitution by use of U.S. Pat. Nos. 4,558,333, 4,459,600 disclosing the constitution having the heat acting portion arranged in the flexed region is also included in the present invention. In addition, the present invention can be also effectively made the constitution as disclosed in Japanese Patent Laid-Open Application No. 59-123670 which discloses the constitution using a slit common to a plurality of electricity-heat converters as the discharging portion of the electricity-heat converter or Japanese Patent Laid-Open Application No. 59-138461 which discloses the constitution having the opening for absorbing pressure waves of heat energy correspondent to the discharging portion.

Further, as the recording head of the full line type having a length corresponding to the maximum width of recording medium which can be recorded by the recording device, either the constitution which satisfies its length by combination of a plurality of recording heads as disclosed in the above-mentioned specifications or the constitution as one recording head integrally formed may be used, and the present invention can exhibit the effects as described above further effectively.

In addition, the present invention is effective for a recording head of the freely exchangeable chip type which enables electrical connection to the main device or supply of ink from the main device by being mounted on the main device, or for the case by use of a recording head of the cartridge type provided integrally on the recording head itself.

Also, the addition of a restoration means for the recording head, a preliminary or auxiliary heating means, etc. provided as the constitution of the recording device of the present invention is preferable, because the effect of the present invention can be further stabilized. Specific examples of these may include, for the recording head, capping means, cleaning means, pressurization or aspiration means, electricity-heat converters or another heating element or preliminary heating means according to a combination of these, and it is also effective for performing stable recording to perform preliminary mode which performs discharging separate from recording.

Further, as the recording mode of the recording device, the present invention is extremely effective for not only the recording mode only of a primary stream color such as black etc., but also a device equipped with at least one of plural different colors or full color by color mixing, whether the recording head may be either integrally constituted or combined in plural number.

In the embodiments of the present invention as set forth in the above, the use of liquid ink is discussed but any ink which is solid or softened at room temperature may also be used in the present invention. In the ink jet recording apparatus as described above it is a common practice to control the temperature of ink itself within a range of 30° to 70° C., thus adjusting the viscosity of the ink to be within the stable ejection range. Accordingly any ink which is liquid upon applying a recording signal may be used. Furthermore, any ink which is liquefied upon application of thermal energy may also be used in the present invention. Such types of inks include, for example, one which upon application of thermal energy depending on recording signal, is liquefied to be ejected in the form of ink droplet and one which is solidified at the time of arriving at a recording medium. Such types of inks are used for the purpose of, for example, positively utilizing thermal energy as the energy for phase change of ink from solid to liquid to prevent temperature elevation due to thermal energy or using an ink which is solidified when stored to prevent evaporation of ink. When such an ink is to be used, the ink may be held in the form of liquid or solid in recessed portions or through holes of a porous sheet while facing the electro-thermal transducer as shown in, for example, Japanese Laid-Open Patent Application Nos. 54-56847 and 60-71260. In the present invention, the most useful system for use of the inks as described above is the system effecting film boiling as described in the above.

According to the embodiment, the wirings which are extended from the heat generating elements and are connected are arranged in the central portion on the lower side of the driving ICs and are connected to the driving ICs of the heat generating element wirings, a plurality of signal series wirings are arranged on the heat generating resistor element side (recording surface side) on the head rather than the terminals for the wiring connection, and the conductors to connect the recording currents to the ground are arranged in the gap between the adjacent driving ICs. Thus, a plurality of driving ICs can be highly densely installed on the same substrate. The area of the conductor for connecting the recording current to the ground can be enlarged. Therefore, the conductor layer can be substantially formed in a single layer and a recording head of low costs and a high reliability can be realized.

What is claimed is:

1. A recording head having a substrate on which a plurality of heat generating elements as recording elements are arranged and a plurality of driving integrated circuits to drive said plurality of heat generating elements are supported, said recording head comprising:

said substrate;

a plurality of driving wirings supported on the substrate and electrically connecting the heat generating elements to terminals of the driving integrated circuits, said driving wirings extending into at least a portion of a region on the substrate on which the driving integrated circuits are supported and being electrically connected to the driving integrated circuits at positions beneath the driving integrated circuits;

signal series wirings arranged on the substrate at positions closer to the heat generating elements than the terminals of the driving integrated circuits are to the heat generating elements; and conductors which are formed at a second region on the substrate, the second region located between adjacent driving integrated circuits for connecting a recording current to the ground, wherein said driving wirings, said signal series wirings, and said conductors are all formed in a same layer.

2. A head according to claim 1, further comprising liquid channels and discharge ports which are communicated therewith for discharging ink to a recording medium in cooperation with the heat generating elements, wherein recording is executed by discharging the ink by using thermal energy generated by the heat generating elements.

3. A head according to claim 2, wherein a plurality of heat generating elements, ink channels, and discharge ports are arranged in a range corresponding to a maximum width of the recording medium capable of being subject to recording.

4. A substrate for use in a recording head on which a plurality of heat generating elements are arranged to generate thermal energy used to record and a plurality of driving integrated circuits are provided to drive the plurality of heat generating elements, said substrate comprising:

driving wirings supported on said substrate and connecting the heat generating elements to terminals of the driving integrated circuits, said driving wirings extending into at least a portion of a region on said substrate on which the driving integrated circuits are supported and being electrically connected to the driving integrated circuits at positions beneath the driving integrated circuits;

signal series wirings arranged on the substrate at positions closer to the heat generating elements than said terminals of the driving integrated circuits are to the heat generating elements; and conductors which are formed at a second region on said substrate, the second region located between adjacent driving integrated circuits for connecting a recording current to the ground, wherein said driving wirings, said signal series wirings, and said conductors are all formed in a same layer.

5. A recording apparatus comprising:

a recording head having a substrate on which a plurality of heat generating elements as recording elements are arranged and a plurality of driving integrated circuits to drive said plurality of heat generating elements are supported, said substrate including driving wirings supported on said substrate and connecting the heat generating elements to terminals of the driving integrated circuits, said driving wirings extending into at least a portion of a region on said substrate on which the driving integrated circuits are supported and being electrically connected to the driving integrated circuits at positions beneath the driving integrated circuits;

signal series wirings arranged on said substrate at positions closer to the heat generating elements than said terminals of the driving integrated circuits are to said heat generating elements;

conductors which are formed at a second region on said substrate, the second region located between adjacent driving integrated circuits for connecting a recording current to the ground; and conveying means for conveying a recording medium to be recorded by said recording head, wherein said driving wirings, said signal series wirings, and said conductors are all formed in a same layer.

6. Apparatus according to claim 5, wherein said head further includes liquid channels and discharge ports which are communicated therewith for discharging ink to the recording medium in cooperation with the heat generating elements, and wherein recording is executed by discharging the ink by using thermal energy generated by said heat generating elements.

7. Apparatus according to claim 5, wherein a plurality of heat generating elements, ink channels, and discharge ports are arranged in a range corresponding to a maximum width of the recording medium capable of being subjected to recording.

8. A recording head having a substrate on which a plurality of heat generating elements as recording elements are arranged and a plurality of driving integrated circuits to drive said plurality of heat generating elements are supported, said recording head comprising:

said substrate;

a plurality of driving wirings supported on the substrate and electrically connecting the heat generating elements to terminals of the driving integrated circuits, said driving wirings extending into at least a portion of a region on the substrate on which the driving integrated circuits are supported and being electrically connected to the driving integrated circuits at positions beneath the driving integrated circuits;

wherein at least two signal series wirings of signal lines for transmitting a recording data and signal lines for transmitting a control signal are arranged on the substrate at positions closer to the heat generating elements than the terminals of the driving integrated circuits are to the heat generating elements.

9. A head according to claim 8, further comprising a plurality of liquid channels and a plurality of discharge ports which are communicated therewith for discharging an ink onto a recording medium in cooperation with the heat generating elements, wherein recording is effected by discharging the ink using thermal energy generated by the heat generating elements.

10. A recording apparatus comprising:

a recording head having a substrate on which a plurality of heat generating elements as recording elements are arranged and a plurality of driving integrated circuits to drive said plurality of heat generating elements are supported, said recording head comprising:

driving wirings supported on the substrate and electrically connecting the heat generating elements to terminals of the driving integrated circuits, said driving wirings extending into at least a portion of a region on the substrate on which the driving integrated circuits are supported and being electrically connected to the driving integrated circuits at positions beneath the driving integrated circuits; and conveying means for conveying a recording medium to be recorded upon by said recording head, wherein at least two signal series wirings of signal lines for transmitting a recording data and signal lines for transmitting a control signal are arranged on the substrate at positions closer to the heat generating elements than the terminals of the driving integrated circuits are to the heat generating elements.

11. A recording apparatus according to claim 10, wherein said head further comprising a plurality of liquid channels and a plurality of discharge ports which are communicated therewith for discharging an ink onto a recording medium in cooperation with the heat generating elements, wherein recording is effected by discharging the ink using thermal energy generated by the heat generating elements.

12. A recording apparatus according to claim 10, wherein said driving wirings are formed within the substrate.

13. A recording head assembly comprising:

an elongated substrate having a side, a longitudinal margin, and an other longitudinal margin;

a plurality of heat generating elements for generating thermal energy to record, said plural heat generating elements being disposed on the side of said elongated substrate, the plural heat generating elements being arranged in a region of the longitudinal margin of the substrate;

a plurality of driving integrated circuits which drive said plurality of heat generating elements, said driving integrated circuits being spaced apart from said heat generating elements, the integrated circuits being arranged in a substantially centered manner along the length of the substrate;

a plurality of wirings which extend from the heat generating elements and electrically connect to the driving integrated circuits;

a plurality of signal series wirings which serially connect the driving integrated circuits, said signal series wirings being connected in a cascade configuration and being arranged between said integrated circuits in a region of those said integrate circuits on the side thereof nearest the heat generating elements, and which said signal series wirings have terminal connections at said integrated circuits which are covered by said integrated circuits, and terminal connections remote from integrate circuits are arranged in a region of an other longitudinal margin of the substrate; and a plurality of conductors which are formed in a region on the substrate between adjacent said driving integrated circuits and which conduct recording currents to a ground potential.

* * * * *